United States Patent [19]

Katsube et al.

[11] Patent Number: 4,530,557

[45] Date of Patent: Jul. 23, 1985

[54] MICROMINIATURE CONNECTOR

[75] Inventors: Kazuaki Katsube, Tokyo; Masami Kuwabara, Yao, both of Japan

[73] Assignees: Sony Corporation, Tokyo; Hosiden Electronics Co., Ltd., Osaka, both of Japan

[21] Appl. No.: 554,483

[22] Filed: Nov. 22, 1983

[30] Foreign Application Priority Data

Dec. 15, 1982 [JP] Japan ..... 57-219634

[51] Int. Cl.[3] ..... H01R 13/50

[52] U.S. Cl. ..... 339/75 M; 339/176 M; 339/176 MP; 339/218 M

[58] Field of Search ..... 339/176 MP, 176 M, 17 CF, 339/75 M, 276 SF, 218 M; 361/302, 330

[56] References Cited

U.S. PATENT DOCUMENTS

| | | | |
|---|---|---|---|
| 3,665,370 | 5/1972 | Hartmann | 339/176 MP |
| 3,850,499 | 11/1974 | Bauerle et al. | 339/218 M |
| 3,980,386 | 9/1976 | Spadoni, Jr. | 339/218 M |
| 3,993,384 | 11/1976 | Dennis et al. | 339/17 CF |
| 4,052,118 | 10/1977 | Scheingold et al. | 339/17 CF |

FOREIGN PATENT DOCUMENTS

| | | | |
|---|---|---|---|
| 1308146 | 2/1973 | United Kingdom | 339/218 M |

*Primary Examiner*—John McQuade

*Attorney, Agent, or Firm*—Pollock, Vande Sande & Priddy

[57] ABSTRACT

In a connector in which holding portions of contacts are molded in an insulating substrate to hold the contact, a metal plate is molded in the insulating substrate integrally therewith so that it is opposite to and insulated from the contact holding portions.

15 Claims, 12 Drawing Figures

MICROMINIATURE CONNECTOR

BACKGROUND OF THE INVENTION

The present invention relates to a connector and, more particularly, to a microminiature connector suitable for use, for example, with hybrid integrated circuits, semiconductor integrated circuits and the like.

One possible technique for the miniaturization of conventional connectors is to integrally mold a contact holding portion and an insulating substrate as disclosed, for instance, in Hoshino et al in U.S. patent application Ser. No. 443,795 filed on Nov. 22, 1982 "Integrated Circuit Socket Having An Improved Cover", now U.S. Pat. No. 4,497, 529, but, in this case, the insulating substrate is thin, and hence is mechanically weak. Especially in the case of a multiconnector having a number of contacts arranged on an insulating substrate, it is feared that when a mating connector is inserted into or connected with the multiconnector, the substrate will be deformed if it is relatively narrow or thin, or a desired contact pressure cannot be obtained because of the small thickness and hence low mechanical strength of the substrate.

SUMMARY OF THE INVENTION

It is therefore an object of the present invention to provide a mechanically sturdy, miniature connector.

Another object of the present invention is to provide a connector having incorporated therein an electrostatic capacitive element.

According to the present invention, a metal plate is integrally molded in an insulating substrate in adjacent but opposing relation to its contact holding position. The metal plate thus embedded in the insulating substrate provides for increased mechanical strength of the substrate. In this case, the reinforcing metal plate and the contact holding portion held adjacent to each other through an insulating material are integrally molded with a resinous material, forming the insulating substrate assembly as a unitary structure. This eliminates the possibility of electrical connection of contacts by the metal plate. In addition, the metal plate and the contact holding portion are held with the insulating material interposed therebetween. Further, the metal plate in the insulating substrate and the contact holding portion are disposed adjacent to each other to develop therebetween an electrostatic capacitance, which can be led out to the outside via a terminal formed integrally with the metal plate.

DESCRIPTION OF THE PREFERRED EMBODIMENTS

A description will be given, with reference to the drawings, of the connector and its manufacturing method according to the present invention. The present invention will be described as being applied to the so-called multiconnector in which a plurality of contacts are arranged and held on an insulating substrate. A contact array or assembly which comprises the contacts, each consisting of a contact body and a contact holding portion formed as a unitary structure, is made of a sheet metal, with the contact arranged in parallel at regular intervals.

Figure 1:
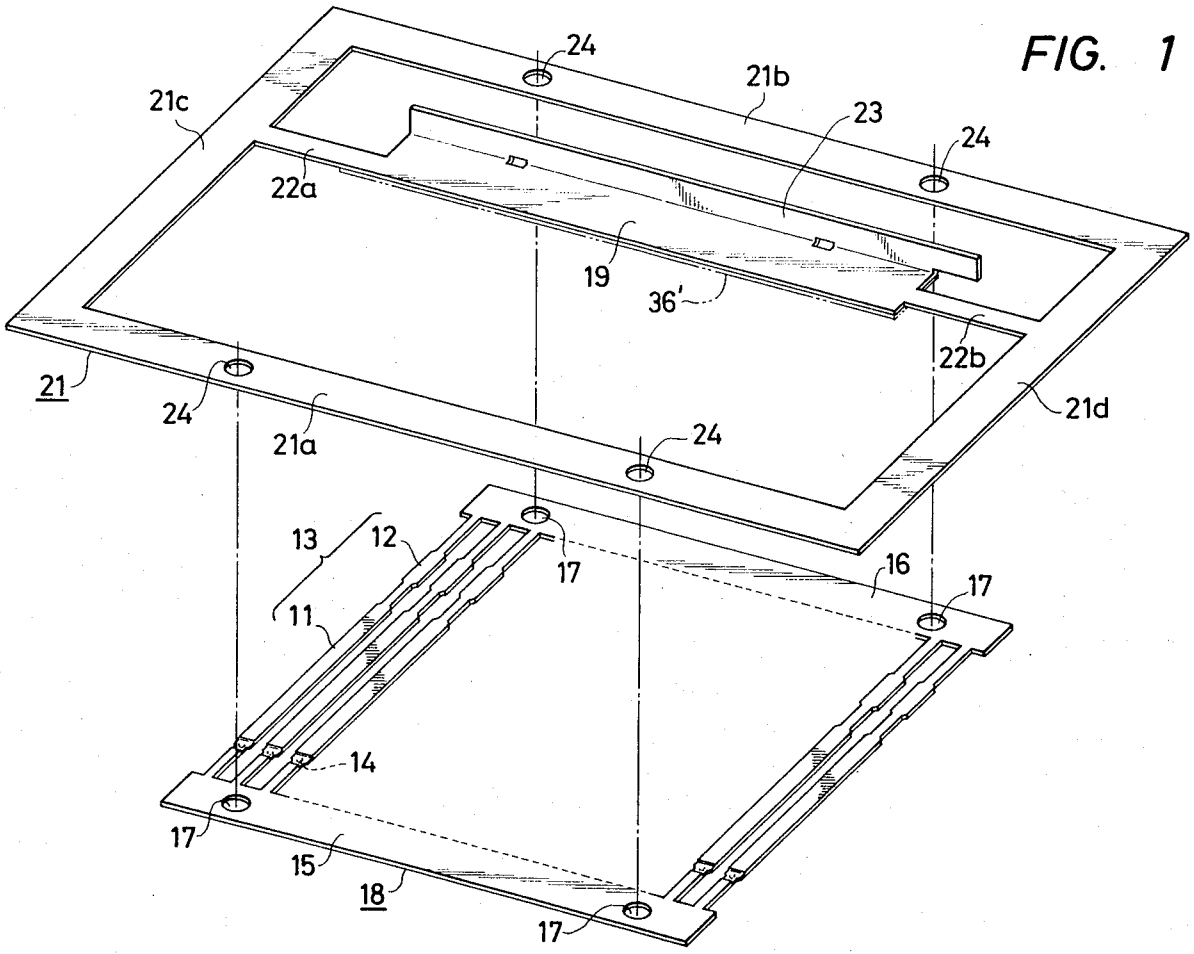
FIG. 1 is a perspective view showing a positioning relationship between a contact array 18 and a metal plate 19 held by a coupling frame 21.

As illustrated in FIG. 1, a conductive portion 11 and a contact holding portion 12 are integrally formed to provide a strip-shaped contact 13. The contact portion 11 has a contact protrusion 14 which is shown to protrude out from the underside thereof, and the coupling portion between the holding portion 12 and the contact portion 11 is made small in width. A plurality of such contacts 13 are arranged in parallel at equal intervals in the same plane and are connected at both ends to coupling plates 15 and 16. The contacts 13 and the coupling plates 15 and 16 are made e.g. by punching a sheet of metal. At the same time, holes 17 for positioning in the subsequent molding step are also made in the coupling plates 15 and 16, respectively. Reference numeral 18 indicates generally the contact array or assembly.

FIG. 1 also shows a reinforcing metal plate 19 which is assembled with the contact array 18 in such a manner as to underlie its contact holding portions 12 through an insulating material. That is, parallel frame members **21*a* and 21*b*, which are spaced apart the same distance as that between the coupling plates 15 and 16 of the contact array 18, are coupled together at both ends by frame members 21*c* and 21*d* to provide a square frame 21. The distance between the frame members 21*c* and 21*d* is selected to be larger than the length of the contact array 18 in the direction of array of the contacts and the length of an insulating substrate described later. The reinforcing metal plate 19 is disposed between the frame members 21*c* and 21*d* and is connected at both ends by coupling arms 22*a* and 22*b* to the frame members 21*c* and 21*d*. One marginal portion of the reinforcing metal plate 19 is bent upwardly at right angles thereto to form a reinforcing rib 23. The frame members 21*a* and 21*b* have made therein positioning holes 24 respectively corresponding to the positioning holes 17 of the coupling plates 15 and 16. The reinforcing metal plate 19 and the square frame 21** are formed as a unitary structure by punching a sheet of metal.

Figure 2:
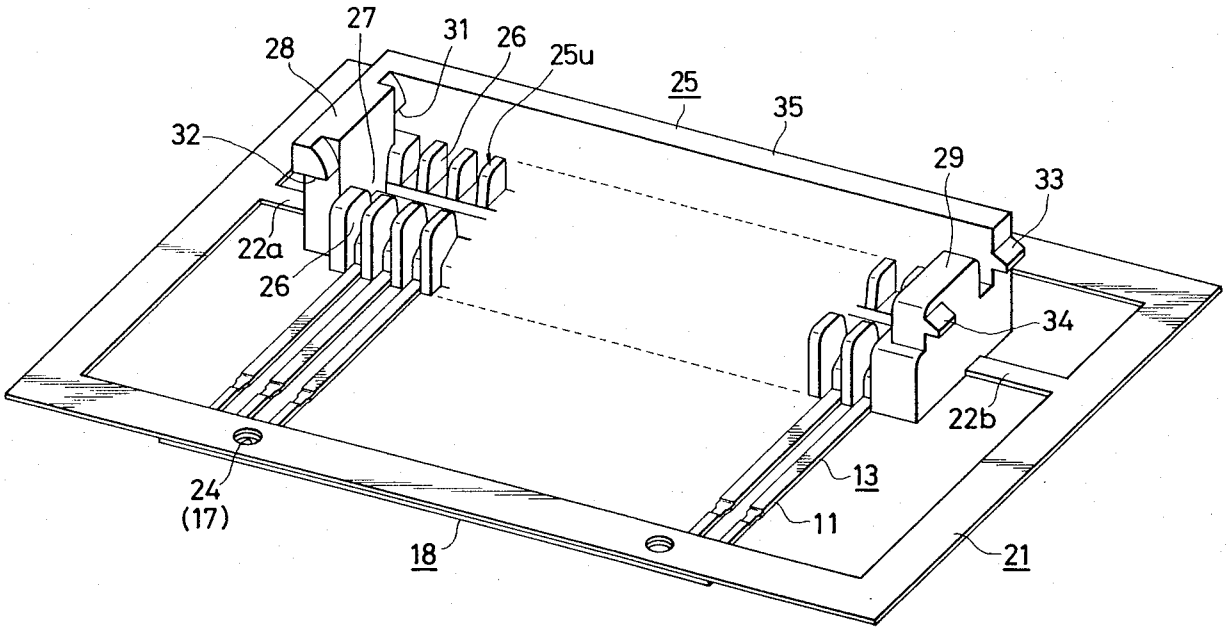
FIG. 2 is a perspective view showing the state in which the metal plate 19 and the contact array 18 held one on the other are molded integrally with an insulating substrate 25.
Figure 3:
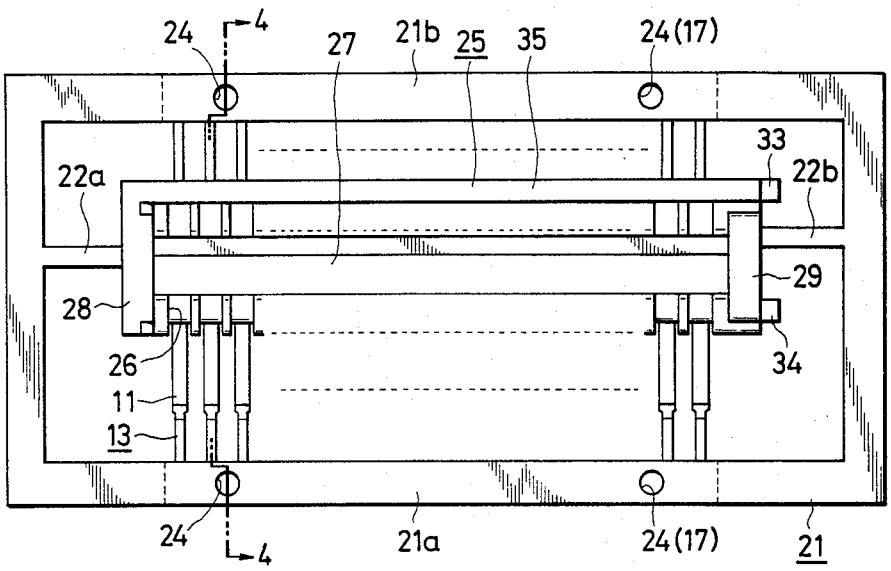
FIG. 3 is a plan view of FIG. 2.

The contact array 18, and the reinforcing metal plate 19 held on the contact holding portions 12 through a spacer of an insulating material and an insulating substrate 25, are integrally molded as illustrated in FIGS. 2 to 4. The insulating substrate 25 is substantially rectangular parallelepipedic in shape and is molded integrally with the contacts 13 disposed to extend through the insulating substrate 25 in a direction perpendicular to its lengthwise direction and in parallel to its one side (bottom) 25*b*. The top surface 25*u* of the insulating substrate 25 has cut therein contact receiving grooves 26 which extend in the widthwise direction thereof corresponding to the respective contacts 13. In this example, an engaging slot 27 is cut in the insulating substrate 25 to extend in its lengthwise direction in a manner to cross each contact receiving groove 26 at the intermediate portion thereof. The insulating substrate 25 has at both ends a pair of opposing mounting portions 28 and 29 which are formed integrally therewith to project upwardly from top surface 25*u* in which the contact receiving grooves 26 are formed. Further, a guide wall 35 is formed integrally with one side of the insulating substrate 25 to extend between the mounting portions 28 and 29 on the opposite side from the direction of projection of the contact portions 11. As shown in FIG. 2, an engaging hole 31 and an engaging notch 32 are formed in the mounting portion 28 at opposite side ends thereof in the widthwise direction of the insulating substrate 25, and a pair of triangular lugs 33 and 34 are formed integrally with the mounting portion 29 and the guide wall 35 at the end thereof on the opposite side from the mounting portion 28.

Figure 4:
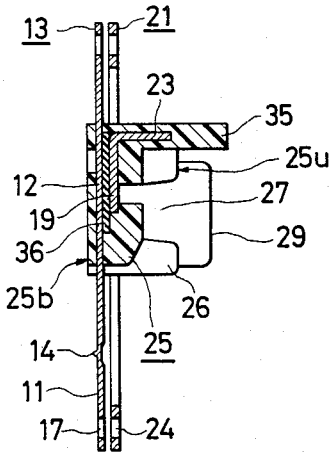
FIG. 4 is a cross-sectional view taken on the line 4—4 in FIG. 3.

As depicted in FIG. 4, the contact holding portions 12 and the reinforcing metal plate 19 are molded in the insulating substrate 25, with a spacer 36 of an insulating material interposed therebetween. In this case, though not shown, the holes 17 of the contact array 18 and the holes 24 of the frame 21 are aligned with each other. In this state the frame 21 and the coupling plates 15 and 16 are fixedly held outside a metal mold in surrounding relation thereto so that the reinforcing metal plate 19 and the contacts 13 are correctly positioned inside the metal mold. The positionings of the reinforcing metal plate and the contacts are such that the rib 23 of the reinforcing metal plate 19 extends in the guide wall 35 with the rib 23 standing up and the contact protrusions 14 facing down. Then, the insulating substrate 25 is formed by injecting a resinous material into the metal mold.

Figure 5:
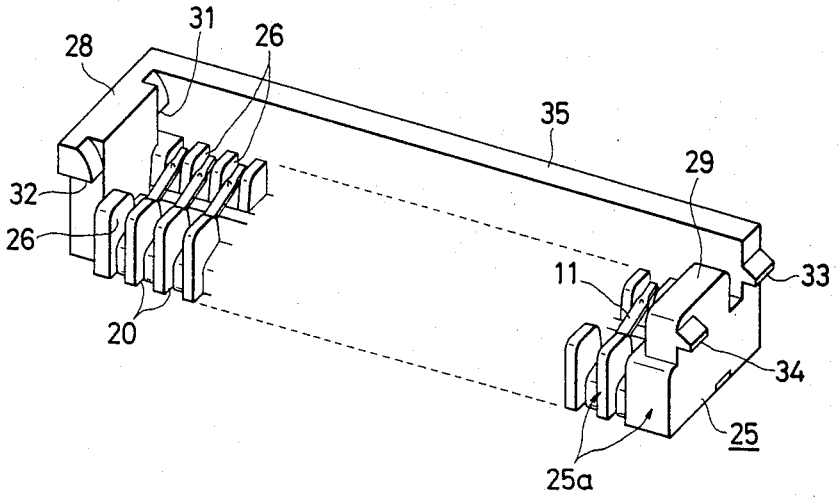
FIG. 5 is a perspective view showing the state in which contacts are mounted on the insulating substrate 25.
Figure 6:
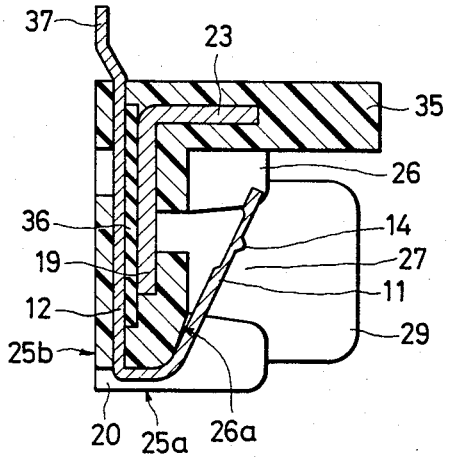
FIG. 6 is its cross-sectional view similar to FIG. 4.

After molding, the coupling plates 15 and 16 of the contact array 18 and the frame 21 of the reinforcing metal plate 19 are cut off. Then, as depicted in FIGS. 5 and 6, each contact portion 11 is bent substantially at right angles along a front side plane 25*a* of the insulating substrate 25 and, further, it is folded back towards the guide wall so as to lie in the contact receiving groove 26. In this case, the contact portion 11 is bent into such a shape that it leaves the bottom of the contact receiving groove as it approaches the guide wall 35. The bending of the plurality of contact portions 11 can be carried out simultaneously using the bottoms of the front grooves 20 formed in the front face 25*a* of the insulating substrate 25 and the bottoms of the contact receiving grooves 26 as bending dies. Accordingly, the bottom of each contact receiving groove 26 on the side of the front face 25*a* of the insulating substrate 25 is gently sloped towards the bottom 25*b* thereof as indicated by 26*a* in FIG. 6. The front grooves 20 receive the base portions of the respective contact portions 11, which grooves communicate with the contact receiving grooves 26. The end portion of each contact 13 projecting out of the guide wall 35 is used as a terminal 37.

Figure 7:
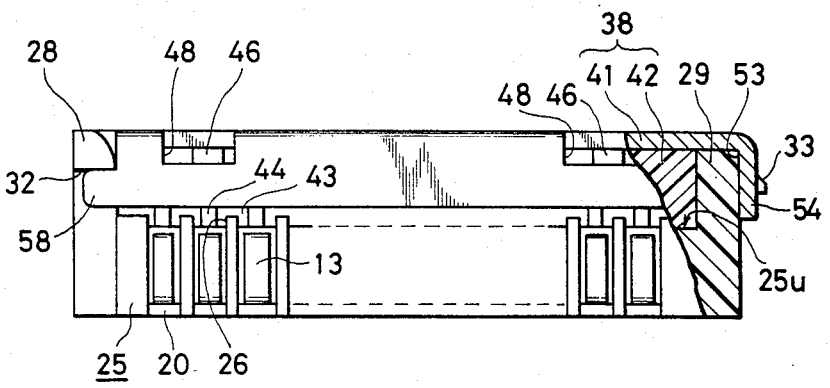
FIG. 7 is a front view illustrating an example of the connector of the present invention.
Figure 8:
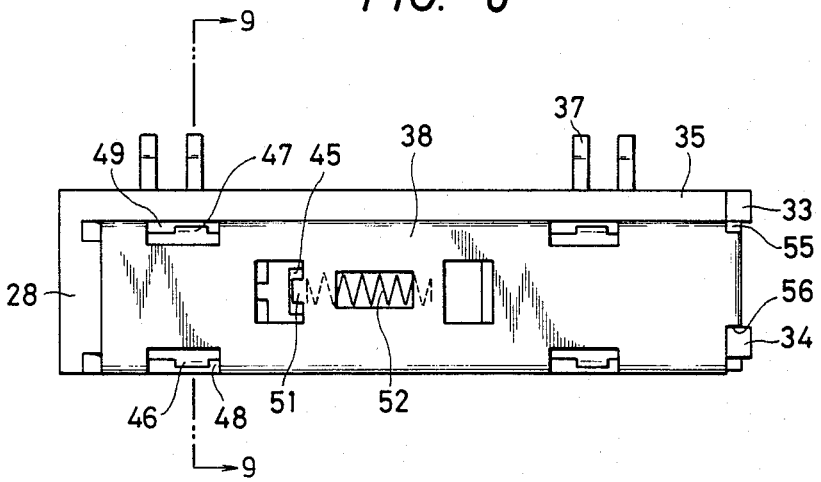
FIG. 8 is a plan view of the connector shown in FIG. 7.
Figure 9:
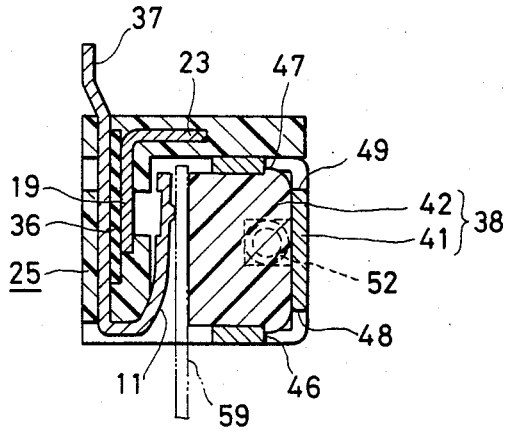
FIG. 9 is a cross-sectional view taken on the line 9—9 in FIG. 8.
Figure 10:
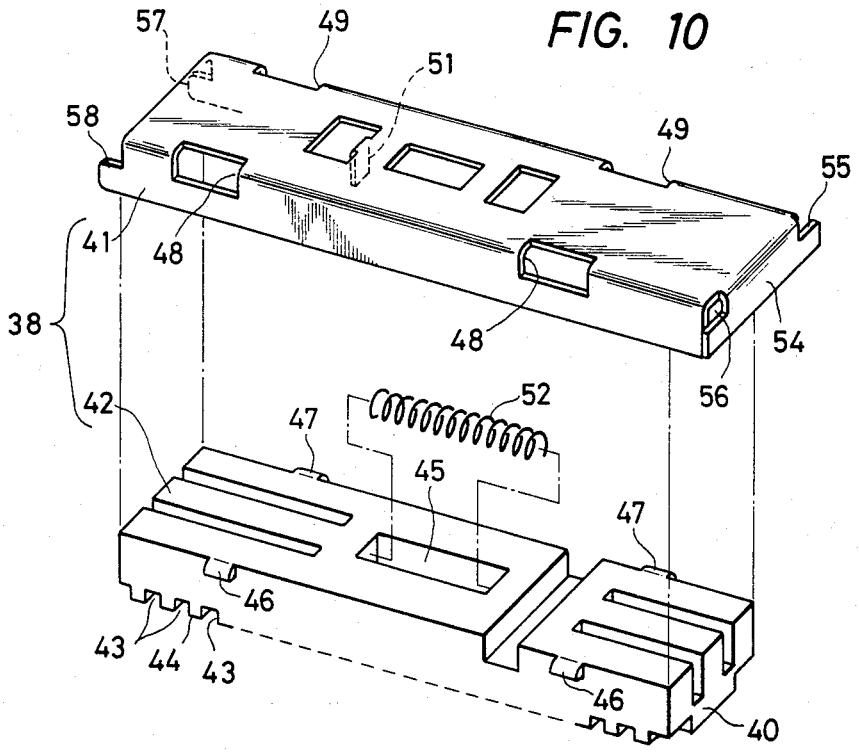
FIG. 10 is an exploded perspective view of a cover 38.

For contacting, for example, terminal pins of a hybrid IC, semiconductor IC or the like with the contact portions 11 thus mounted on the insulating substrate 25, a cover 38 is detachably mounted on the insulating substrate 25 as shown in FIGS. 7 to 10. The cover 38 is comprised of a slider 41 made of sheet metal and a holding plate 42 of an insulating material as depicted in FIG. 10. As illustrated in FIG. 7, the holding plate 42 is disposed on the upper face 25*u* of the insulating substrate 25 on which the contact portions are arranged. The holding plate 42 has such a length that it is snugly fitted between the mounting portions 28 and 29, and has a width substantially equal to that of the upper face 25*u* of the insulating substrate 25. Further, the underside of the holding plate 42 has cut therein at both marginal portions grooves 43 in opposing relation to projections between adjacent ones of the contact receiving grooves 26. Projecting portions 44 defined by adjacent ones of the grooves 43 are respectively fitted into the contact receiving grooves 26, and a portion 40 between the inner ends of the grooves 43 on both marginal portions is fitted into the slot 27. A coil spring housing recess 45 is formed in the top surface of the holding plate 42 centrally thereof. The holding plate 42 has engaging pawls 46 and 47 (FIG. 8) on both sides thereof in its lengthwise direction.

The slider 41 is formed by bending a sheet of metal into a U-shape in cross-section as shown in FIG. 10, and the holding plate 42 is supported in the slider 41 in a manner to be slidable in its lengthwise direction. On both sides of the slider 41 are formed notches 48 and 49 for engagement with the pawls 46 and 47, respectively. When the holding plate 42 is fitted into the slider 41, the pawls 46 and 47 project into the notches 48 and 49 (see FIGS. 7 and 8) to prevent the holding plate 42 from getting out of the slider 41 and to permit them to slide in their lengthwise direction relative to each other. That is, the notches 48 and 49 are longer than the pawls 46 and 47 in the lengthwise direction of the slider 41. The slider 41 has a receiving piece 51 which is set up on the side of the holding plate 42 and disposed in the spring housing recess 45 of the holding plate 42. As shown in FIG. 8, the spring housing recess 45 has housed therein a coiled spring 52, which is interposed between the receiving piece 51 and the wall of the housing recess 45 at one end thereof and by which the slider 41 and the holding plate 42 are biased to the left and to the right in FIG. 8, respectively.

One end of the slider 41 on the side of the mounting portion 29 of the insulating substrate 25 is bent to form an end plate 54 so that in the abovesaid biased state, the mounting portion 29 is sandwiched between the end plate 54 of the slider 41 and one end of the holding plate 42 as shown in FIG. 7. The end plate 54 has a projection 55 and a hole 56 for engagement with the pawls 33 and 34 of the insulating substrate 25 when the cover 38 is mounted thereon. Further, the slider 41 has projecting pieces 57 and 58 formed integrally therewith at one end on the side of the mounting portion 28 of the insulating substrate 25 for engagement with the hole 31 and the notch 32 thereof when the cover 38 is mounted on the insulating substrate 25. The surfaces of the engaging portions of the mounting portion 28 for engagement with the projecting pieces 57 and 58 are tapered.

In the state shown in FIG. 9 in which terminal pins 59 mounted on a substrate of a hybrid integrated circuit are each disposed on each contact portion 11 to extend in the contact receiving groove 26, when the cover 38 is mounted on the insulating substrate 25 with its mounting portion 29 held between the end plate 54 of the slider 41 and the holding plate 42 and then the slider 41 is pressed against the insulating substrate 25, the projecting pieces 57 and 58 move along the tapered surfaces of the engaging portions of the mounting portion 28. Consequently, the slider 41 moves to the right in FIGS. 7 and 8 relative to the holding plate 42 against the biasing force of the coiled spring 52 and, at the position where the bottom 40 of the holding plate 42 engages the slot 27 of the insulating substrate 25, the slider 41 is moved by the biasing force of the coiled spring 52 in the direction in which to engage the projecting pieces 57 and 58 with the hole 31 and the notch 32, respectively. In this state the terminal pin 59 is resiliently urged by the holding plate 42 into contact with the contact portion 11. When it is desired to remove the cover 38 from the insulating substrate 25, the slider 41 is moved against the biasing force of the coiled spring 52 to disengage the projecting pieces 57 and 58 from the hole 31 and the notch 32 and the pawls 33 and 34 from the projecting piece 55 and the hole 56, respectively.

As described above, the connector of the present invention has the reinforcing metal plate 19 embedded in the insulating substrate 25, and hence is mechanically strong. Accordingly, the insulating substrate 25 can be made very thin and small. Further, since the insulating spacer 36 is interposed between the holding portions 12 of the contacts 13 and the reinforcing metal plate 19, there are no possibilities of the contacts 13 being electrically shorted by the reinforcing metal plate 19, and they can be integrally molded together with the insulating substrate 25. Especially in the case of using the reinforcing metal plate 19 having the reinforcing rib 23 formed integrally therewith by bending its one marginal portion, the mechanical strength of the connector can be further increased. Moreover, since the metal plate 19 is disposed in close proximity to the contact holding portions 12, an electrostatic capacitance is developed between the contact holding portions 12 and the metal plate 19, and this electrostatic capacitance can also be utilized as an electrostatic capacitance element forming a part of the circuit. In this case, it is preferable that the spacer 36 which is interposed between the contact holding portions 12 and the metal plate 19 be made of a dielectric material having a large dielectric constant. From this point of view, the metal plate 19 need not always serve as a reinforcement.

As the material for the insulating substrate 25, it is possible to use a thermoplastic or thermosetting resin such as polyamide resin, phenol resin or the like. As regards the spacer 36, it is preferred to use a material which withstands the heat of molding and does not cause shorting between the metal plate 19 and the contacts 13; for example, polyamide resin or the like can be employed.

It is sufficient if only an insulator be interposed between the metal plate 19 and the contact holding portions 12, and it is not always necessary to provide the separate spacer 36. That is, a film of an insulating material may be provided as the spacer 36 as described previously, but it is also possible to form an insulating layer 36' by coating, printing or surface oxidation at least on the surface of the metal plate 19 on the side of the contact holding portions 12 as indicated by the one-dot chain lines of FIG. 1. Similarly, an insulating layer may also be formed as by coating or printing on the surfaces of the contact holding portions 12 on the side of the metal plate 19. It is also possible, of course, to provide insulating layers on both the metal plate 19 and the contact holding portions 12. Further, it is also possible to provide the film-like insulating layer 36' on one or both of the metal plate 19 and the contact holding portions 12 by means of primary forming. Moreover, it is possible to join the contact holding portions 12 and the metal plate 19 using an adhesive material layer and to use it as the insulating layer 36 interposed therebetween. In this case, it is possible to employ a two-sided adhesive tape for joining them together and to utilize the tape as the intervening insulating layer 36.

In the foregoing embodiment the contact portions 11 are bent to be housed in the contact receiving grooves, but it is also possible that the contact portions be bent into a desired shape in advance and then molded integrally with the insulating substrate 25. Further, bending of the contacts 13 and cutting off of the coupling plates 15 and 16 and the frame 21 can be carried out at the same time. The insulating layer 36 intervening between the metal plate 19 and the contact holding portions 12 may also be a mesh-like sheet, by which the electrostatic capacitance developed between them can be reduced. Also it is possible to use a mesh-like insulating member which is molten into a thin film during molding of the insulating substrate 25.

Figure 11:
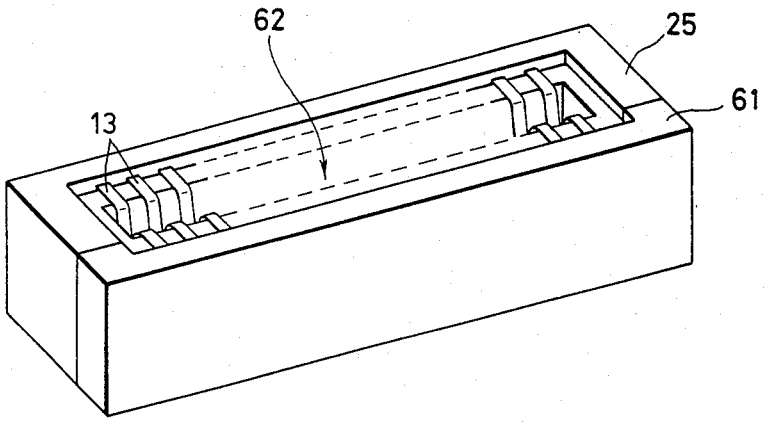
FIG. 11 is a perspective view illustrating another example of the connector of the present invention.

The present invention is not limited specifically to the connector of the type wherein the terminal pins 59 mounted on the contact portions 11 are pressed by the cover 38 into contact therewith. FIG. 11 illustrates another embodiment of the connector of the present invention. This connector is comprised of an insulating substrate assembly in which the contacts 13 are molded integrally with a first insulating substrate 25 as shown in FIG. 5, and another insulating substrate assembly is fabricated in which further contacts arranged at the same pitch as the abovesaid ones and in contact with the guide wall 35 of the abovesaid insulating substrate 25 are held by a second insulating substrate 61. (The second-mentioned contacts may also be omitted.) These two insulating substrate assemblies are coupled together to form therebetween a mating connector receiving opening 62. Also in this case, reinforcing metal plates can be embedded in both insulating substrates 25 and 61, respectively. If these metal plates are not provided, when a mating connector is inserted into the connector receiving opening 62, the opening 62 tends to open wide centrally thereof, introducing the possibility of bad contact between the connectors. The provision of the metal plates 19 eliminates such a possibility and permits the reduction of the thickness and the size of the insulating substrates 25 and 61.

Figure 12:
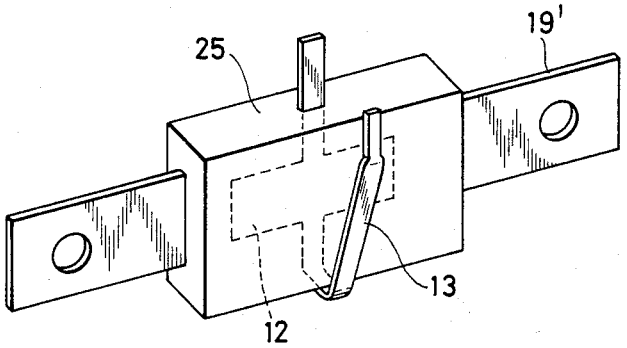
FIG. 12 is a perspective view illustrating still another example of the connector of the present invention.

Moreover, the present invention is not limited specifically to the connector of the type having a number of contacts arranged in the manner described previously, but may also be applied to a connector of the type shown in FIG. 12 in which one contact 13 is held by the insulating substrate 25. In this case, the holding portion 12 of the contact 13 and the metal plate 19 constitute an electrostatic capacitance; this structure is suitable for use when the electrostatic capacitance is utilized. Accordingly, it is preferable that the area of the holding portion 12 of the contact 13 facing the metal plate 19 be large, and a terminal 19' integral with the metal plate 19 is led out from the insulating substrate 25.

It will be apparent that many modifications and variations may be effected without departing from the scope of the novel concepts of the present invention.

What is claimed is:

1. A connector comprising:

an insulating substrate having a substantially rectangular parallelepiped shape, a plurality of strip-shaped contacts arranged substantially in parallel to one another at regular intervals, said contacts being molded integrally with said insulating substrate so as to extend through said substrate in a direction perpendicular to the lengthwise direction of said substrate with the opposing ends of said contacts projecting outwardly of said substrate, each said contact defining a terminal portion at one of its outwardly projecting ends, a contact portion at the other of its outwardly projecting ends, and a contact holding portion which is located between said ends and embedded within said insulating substrate, each of said contact portions being bent back towards its corresponding contact holding portion to lie on one surface of said insulating substrate, the surface of said insulating substrate having contact receiving grooves therein which extend in the widthwise direction of said substrate and which are arranged along the lengthwise direction of said substrate for receiving said bent back contact portions, an elongated metal reinforcing plate embedded within said insulating substrate, said reinforcing plate extending in the lengthwise direction of said substrate and being disposed adjacent to, spaced from, and in opposing relation to said contact holding portions, and insulating layer means disposed between said reinforcing metal plate and each of said contact holding portions, said insulating layer means being made of an insulating material different from the material of said insulating substrate.

2. A connector according to claim 1 including a terminal formed integrally with the metal reinforcing plate and extending outwardly from the insulating substrate for electrical connection to an electrostatic capacitance between the metal reinforcing plate and each contact holding portion.

3. A connector according to claim 1 which further includes a cover detachably mounted on the insulating substrate in facing relation to the contact receiving grooves for pressing terminal pins, that have been inserted into the contact receiving grooves, against said bent back contact portions.

4. A connector according to claim 3, wherein the cover is provided with a slider and a holding plate slidable relative to each other in the lengthwise direction of the insulating substrate, said cover including means for biasing the slider and the holding plate in a fixed one of the directions of their sliding movement, and said cover further including engaging means operative, when the cover is pressed against the insulating substrate with the holding plate held on a side thereof, to cause the slider to slide against the biasing force of the biasing means and then to be returned by the biasing force into engagement with the insulating substrate.

5. A connector according to claim 1, wherein a second insulating substrate is assembled with the insulating substrate on the side of its contact receiving grooves to define therebetween an opening communicating with the contact receiving grooves, for receiving a mating connector inserted into said opening from the side of the contact bent back portions of the contact receiving grooves.

6. A connector according to claim 5, wherein the second insulating substrate has embedded therein a reinforcing metal plate extending in its lengthwise direction.

7. A connector according to claim 6, wherein a plurality of second contacts are held by the second insulating substrate in side by side relation to one another in the lengthwise direction of said second substrate, said second contacts having contact holding portions which are embedded in the second insulating substrate and also having contact portions which are received in second contact receiving grooves formed in the second insulating substrate to communicate with said mating connector receiving opening.

8. A connector according to claim 1, wherein said reinforcing metal plate is disposed opposite to said contact holding portions on the side of said bent back contact portions, the marginal portion of said reinforcing metal plate on the opposite side from the bent back contact portions being bent substantially at right angles towards said contact portions to form a reinforcing rib.

9. A connector according to any one of claims 1 or 3 to 8, wherein the insulating layer means is a spacer of an insulating material.

10. A connector according to any one of claims 1 or 3 to 8, wherein the insulating layer means is a coating of an insulating material on the surface of the metal reinforcing plate.

11. A connector according to any one of claims 1 or 3 to 8, wherein the insulating layer means is a layer of oxidation on the surface of the metal reinforcing plate.

12. A connector according to any one of claims 1 or 3 to 8, wherein the insulating layer means is a coating of an insulating material on each contact holding portion.

13. A connector according to any one of claims 1 or 3 to 8, wherein the insulating layer means constitutes coatings of an insulating material on each contact holding portion and on the metal plate.

14. A connector according to any one of claims 1 or 3 to 8, wherein the insulating layer means is an insulating adhesive binder layer joining each contact holding portion to the metal plate.

15. A connector according to any one of claims 1 or 3 to 8, wherein the insulating layer means is a two-sided adhesive tape joining each contact holding portion to the metal plate.

* * * * *